US008549872B2

(12) United States Patent
Kwon et al.

(10) Patent No.: US 8,549,872 B2
(45) Date of Patent: Oct. 8, 2013

(54) REFRIGERATOR

(75) Inventors: Hong Sik Kwon, Seoul (KR); Yong Hun Chang, Seoul (KR); Jung Yeon Hwang, Seoul (KR); Seon Il Yu, Seoul (KR)

(73) Assignee: LG Electronics Inc., Seoul (KR)

( * ) Notice: Subject to any disclaimer, the term of this patent is extended or adjusted under 35 U.S.C. 154(b) by 266 days.

(21) Appl. No.: 12/792,588

(22) Filed: Jun. 2, 2010

(65) Prior Publication Data

US 2010/0307187 A1 Dec. 9, 2010

(30) Foreign Application Priority Data

Jun. 3, 2009 (KR) ..... 10-2009-0049002

(51) Int. Cl.

| | |
|---|---|
| ***A47B 96/04*** | (2006.01) |
| ***A47B 88/00*** | (2006.01) |
| ***A47B 81/00*** | (2006.01) |
| ***A47B 97/00*** | (2006.01) |
| ***F25D 25/02*** | (2006.01) |
| ***F25D 11/02*** | (2006.01) |
| ***F25D 25/00*** | (2006.01) |

(52) U.S. Cl.
USPC ..... 62/382; 312/323; 312/271; 312/404; 62/441; 62/465

(58) Field of Classification Search
USPC ..... 62/465, 382, 302; 312/404, 408, 322, 312/323, 311, 310, 331, 306, 312, 247, 248, 312/319.5–319.8, 271, 273–276
See application file for complete search history.

(56) References Cited

U.S. PATENT DOCUMENTS

| | | | | | |
|---|---|---|---|---|---|
| 1,589,306 | A | * | 6/1926 | Short | 312/274 |
| 1,902,795 | A | * | 3/1933 | Wolters | 312/331 |
| 1,940,877 | A | * | 12/1933 | Ochse | 312/322 |
| 2,244,168 | A | * | 6/1941 | Miller | 99/337 |
| 2,388,922 | A | * | 11/1945 | Liesken | 312/274 |
| 2,534,784 | A | * | 12/1950 | Maxwell | 355/85 |
| 2,767,041 | A | * | 10/1956 | Burger et al. | 312/298 |
| 2,895,781 | A | * | 7/1959 | Latter et al. | 312/319.7 |
| 2,926,507 | A | * | 3/1960 | Ingolia | 62/377 |

(Continued)

FOREIGN PATENT DOCUMENTS

| | | | |
|---|---|---|---|
| DE | 2524962 | A * | 12/1976 |
| JP | 2002-228351 | A | 8/2002 |
| WO | WO 2008/130109 | A1 | 10/2008 |

OTHER PUBLICATIONS

Machine Translation of DE2524962A.*

(Continued)

*Primary Examiner* — Janet M Wilkens
*Assistant Examiner* — Andrew Roersma
(74) *Attorney, Agent, or Firm* — Fish & Richardson P.C.

(57) ABSTRACT

The present disclosure relates to a refrigerator. The refrigerator includes a cold air generator configured to generate cold air. The refrigerator also includes a first storage chamber configured to receive the cold air generated by the cold air generator. The refrigerator further includes a first storage chamber door configured to open and close an access point to the first storage chamber and configured to store at least one of food and ice stuffs. In addition, the refrigerator includes a second storage chamber, having a container and positioned on the first storage chamber, wherein the second storage chamber is configured to be movable in front and rear directions.

27 Claims, 6 Drawing Sheets

(56) References Cited

U.S. PATENT DOCUMENTS

| | | | | |
|---|---|---|---|---|
| 3,081,138 | A * | 3/1963 | Stebbins | 312/319.3 |
| 3,734,588 | A * | 5/1973 | Ellis | 312/247 |
| 4,087,140 | A * | 5/1978 | Linstromberg | 312/292 |
| 4,615,570 | A * | 10/1986 | Goodman | 312/110 |
| 4,749,242 | A * | 6/1988 | Rechberg | 312/333 |
| 5,076,649 | A * | 12/1991 | Therkelsen | 312/246 |
| 5,934,615 | A * | 8/1999 | Treichler et al. | 244/118.5 |
| 6,499,818 | B2 * | 12/2002 | Brustle | 312/319.1 |
| 6,752,475 | B2 * | 6/2004 | Steadman | 312/246 |
| 7,527,343 | B2 * | 5/2009 | Oh et al. | 312/402 |
| 7,770,986 | B1 * | 8/2010 | Simaitis | 312/247 |
| 2003/0067257 | A1 * | 4/2003 | Gasser | 312/331 |
| 2004/0066121 | A1 * | 4/2004 | Steadman | 312/310 |
| 2004/0189164 | A1 * | 9/2004 | Hwang | 312/405 |
| 2005/0073225 | A1 * | 4/2005 | Kwon et al. | 312/402 |
| 2005/0223731 | A1 | 10/2005 | Saeki et al. | |
| 2006/0021373 | A1 * | 2/2006 | Oh et al. | 62/407 |
| 2006/0042299 | A1 * | 3/2006 | Oh et al. | 62/348 |
| 2010/0162745 | A1 | 7/2010 | Kim | |

OTHER PUBLICATIONS

PCT International Search Report and Written Opinion for Application No. PCT/KR2010/003454 dated Sep. 1, 2011, 15 pages.

* cited by examiner

REFRIGERATOR

CROSS REFERENCE TO RELATED APPLICATION

This application claims the benefit of priority to Korean Application No. 10-2009-0049002, filed on Jun. 3, 2009, which is hereby expressly incorporated by reference it its entirely.

FIELD

The present disclosure relates to refrigerators.

BACKGROUND

In general, a refrigerator uses cold air produced as refrigerant vaporizes and absorbs heat from the air.

In detail, the refrigerant is compressed at a compressor, and forwarded to an evaporator via an expansion valve, where the refrigerant vaporizes. The refrigerant absorbs heat from surroundings in such a vaporizing process, to cool down surrounding air to produce the cold air.

The cold air is forwarded to the refrigerating chamber or the freezing chamber for maintaining the refrigerating chamber or the freezing chamber to be below a fixed temperature.

Depending on arrangement of the refrigerating chamber or the freezing chamber, in the refrigerators, there are a top mount-type refrigerator in which the freezing chamber is arranged on the refrigerating chamber, a bottom freezer type refrigerator in which the freezing chamber is arranged under the refrigerating chamber, and a side by side type refrigerator in which the refrigerating chamber and the freezing chamber are arranged side by side. Above sorting is just for convenience's sake, but not absolute ones.

The bottom freezer type refrigerator has an inside space partitioned with a barrier an upper side of which is the refrigerating chamber and a lower side of which is the freezing chamber.

In general, the refrigerating chamber has at least one refrigerating chamber door rotatably mounted thereto to open/close the refrigerating chamber, and the freezing chamber has a drawer structure which is slidably move back and forth to open/close the freezing chamber.

In general, in rear of the freezing chamber and the refrigerating chamber, there are the evaporators and fans for blowing the cold air respectively, for generating the cold air individually to control temperatures of the freezing chamber and the refrigerating chamber, respectively.

SUMMARY

In one aspect, a refrigerator includes a cold air generator configured to generate cold air. The refrigerator also includes a first storage chamber configured to receive the cold air generated by the cold air generator. The refrigerator further includes a first storage chamber door configured to open and close an access point to the first storage chamber and configured to store at least one of food and ice stuffs. In addition, the refrigerator includes a second storage chamber, having a container and positioned on the first storage chamber, wherein the second storage chamber is configured to be movable in front and rear directions.

Implementations may includes one or more of the following features. For example, the container is configured to be movable up and down. The container is configured to move down with no electrical driving force. The second storage chamber is configured to slidably move in front and rear directions. The refrigerator further includes a moving up and down support connected to the container and configured to support the container when the container moves up and down from a top of the first storage chamber.

The refrigerator further includes a speed reducing device mounted to the moving up and down support and configured to reduce a moving down speed of the container. The refrigerator further includes a first slider mounted to the moving up and down support, and configured to slide along a first sliding guide.

In some examples, the refrigerator further includes a drawing out plate slidably connected to the second storage chamber. The refrigerator further includes a second slider mounted to the drawing out plate and configured to be slidable along a second sliding guide. The refrigerator further includes a stopper connected to the second sliding guide and configured to prevent the container from moving beyond the stopper in a reversal direction. The refrigerator further includes a second storage chamber door configured to open and close the second storage chamber.

In some implementations, the refrigerator further includes a link rotatably connected to the second storage chamber door and a rack connected to the link and configured to rotate to expose the container of the second storage chamber. The first storage chamber is at least one of a refrigerating chamber and a freezing chamber. The refrigerator further includes a compressor positioned in a rear part of the second storage chamber and configured to compress the refrigerant.

The second storage chamber is supplied with the cold air generated by the cold air generator. The refrigerator further includes a motor configured to move the second storage chamber in response to a command.

In another aspect, a refrigerator includes a cold air generator configured to generate cold air. The refrigerator also includes a first storage chamber configured to receive the cold air generated by the cold air generator. The refrigerator further includes a storage chamber door configured to open and close at least the first storage chamber and configured to store at least one of food and ice stuffs. In addition, the refrigerator includes a second storage chamber, having a container and positioned on the first storage chamber, wherein the container is configured to be movable in front and rear directions.

Implementations may includes one or more of the following features. For example, the container is configured to be movable up and down. The refrigerator further includes a drawing out plate slidably connected to the second storage chamber. The refrigerator further includes a slider mounted to the drawing out plate and configured to be slidable along a sliding guide. The refrigerator further includes a stopper connected to a sliding guide and configured to prevent the container from moving in a reversal movement.

In some examples, the first storage chamber is at least one of a refrigerating chamber and a freezing chamber. The refrigerator further includes a compressor positioned in a rear part of the second storage chamber and configured to compress the refrigerant. The second storage chamber receives the cold air generated by the cold air generator. The storage chamber door is configured to open and close the second storage chamber. The second storage chamber having the container is configured to move in front and rear directions.

In yet another aspect, a refrigerator includes a cold air generator configured to generate cold air. The refrigerator also includes a first storage chamber configured to receive the cold air generated by the cold air generator. The refrigerator further includes a storage chamber door configured to open and close at least the first storage chamber and configured to store at least one of food and ice stuffs. In addition, the refrigerator includes a second storage chamber, having a container and positioned on the first storage chamber, wherein the container is configured to be movable up and down.

Implementations may include one or more of the following features. For example, the container is configured to be movable in front and rear directions. The refrigerator further includes a moving up and down support connected to the container and configured to support the container when the container moves up and down. The refrigerator further includes a speed reducing device mounted to the moving up and down support and configured to reduce a moving down speed of the container.

In some examples, the refrigerator further includes a storage chamber door configured to open and close the second storage chamber. The first storage chamber is at least one of a refrigerating chamber and a freezing chamber. The refrigerator further includes a compressor positioned in a rear part of the second storage chamber and configured to compress the refrigerant. The storage chamber door is configured to open and close the second storage chamber.

DETAILED DESCRIPTION

Reference will now be made in detail to the specific implementation of the present disclosure, examples of which are illustrated in the accompanying drawings.

Figure 1:
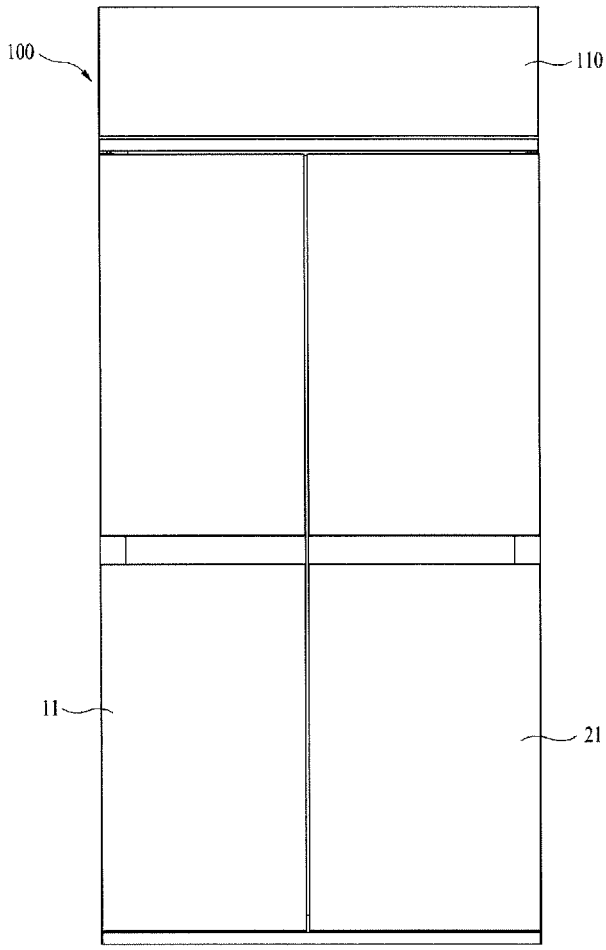
FIG. 1 illustrates a view of a refrigerator.

Referring to FIG. 1, the refrigerator 100 includes a refrigerating chamber opened/closed by a refrigerating chamber door 21 and a freezing chamber opened/closed by a freezing chamber door 11, arranged side by side in a length. Besides the refrigerating chamber or the freezing chamber, there is a storage chamber 116*a* provided as a separate storage space (see FIG. 3).

The storage chamber 116*a* is positioned on the refrigerating chamber and the freezing chamber.

Figure 2:
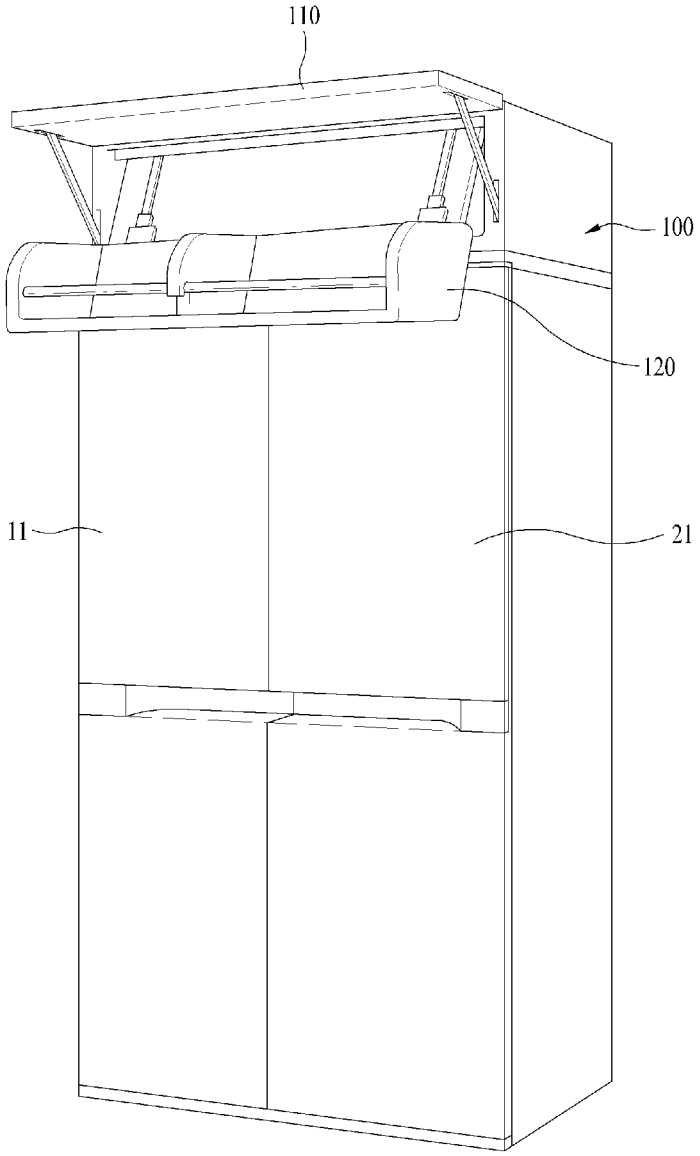
FIG. 2 illustrates a perspective view of the refrigerator in FIG. 1, with a storage chamber thereof opened.

FIG. 2 illustrates when a container 120 is drawn forward and moved down. As shown in FIG. 2, there is a storage chamber door 110 has a rotatably supported upper side to make a lower side to open rotatably.

A drawing out/pushing structure of the container 120 will be described with reference to FIGS. 3 and 4.

The storage chamber door 110 is an upper side hinged on a frame of the storage chamber 116*a*.

The storage chamber door 110 has a structure in which an upper side thereof is rotatably fixed to enable a lower side thereof to open rotatably.

The storage chamber door 110 is rotatably coupled to a link 144. The link 144 is connected to a rack 141 mounted in the frame of the storage chamber 116*a* so as to be movable in front/rear directions. The rack 141 is engaged with a gear 142, and the gear 142 is connected to a rotation shaft of a motor 143.

If the gear 142 rotates following rotation of the motor 143, the rack 141 moves forward. In this instance, the link 144 coupled to the rack 141 pushes and opens the storage chamber door 110.

The motor 143 is put into operation in response to a signal from a switch (not shown). The switch can be mounted to anywhere on an outside surface of the refrigerator 100. The motor 143 is put into operation as the user presses the switch to open the door 110.

The rack 141 has a drawing out projection for pushing a rear side of the container 120 to push the container 120 forward. According to this, as the storage chamber door 110 is opened by the motor 143, the container 120 is drawn out. The drawing out projection 141*a* is positioned to push out the container 120 in a range in which the opening of the storage chamber door 110 and the drawing out of the container 120 do not interfere each the other.

There is one pair of second sliding guides 114 on opposite sides of the storage chamber 116*a*.

Each of the second sliding guides 114 has a second slider 117 sildably mounted thereto. There is a drawing out plate 151 connected between the one pair of the second sliders 117. According to this, the drawing out plate 151 is slidable in front/rear directions.

Figure 5:
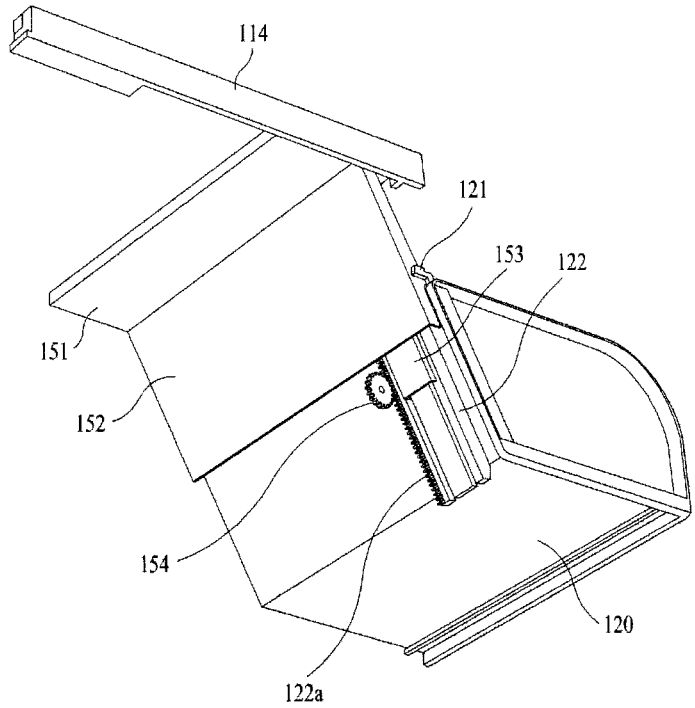
FIG. 5 illustrates a perspective view of an up/down moving structure of the container.

Referring to FIG. 5, there is a moving up/down support 152 connected to an underside of the drawing out plate 151. The moving up/down support 152 has an upper side leaned backward such that the moving up/down support 152 is mounted in a tilted position. According to this, the moving up/down support 152 has a sloped front surface.

There is a first sliding guide 153 mounted on a front surface of the moving up/down support 152.

There is a first slider 122 mounted to the container 120 so as to be slidable along the first sliding guide 153. Accordingly, following sliding of the first slider 122, the container 120 moves up/down.

The first slider 122 is slidably mounted to the first sliding guide 153 such that the container 120 moves down by gravity.

There is a speed reducing device for reducing a speed of the container 120. The speed reducing device includes a rack gear 122*a* on one side of the first slider 122, a reducer 154 connected to the rack gear 122*a*. The reducer 154 is a rotatable body having friction. At the time the rotatable body is rotated by the rack gear 122*a*, the speed is reduced by the friction.

If the container 120 is pushed up, the container 120 moves up/down.

Figure 4:
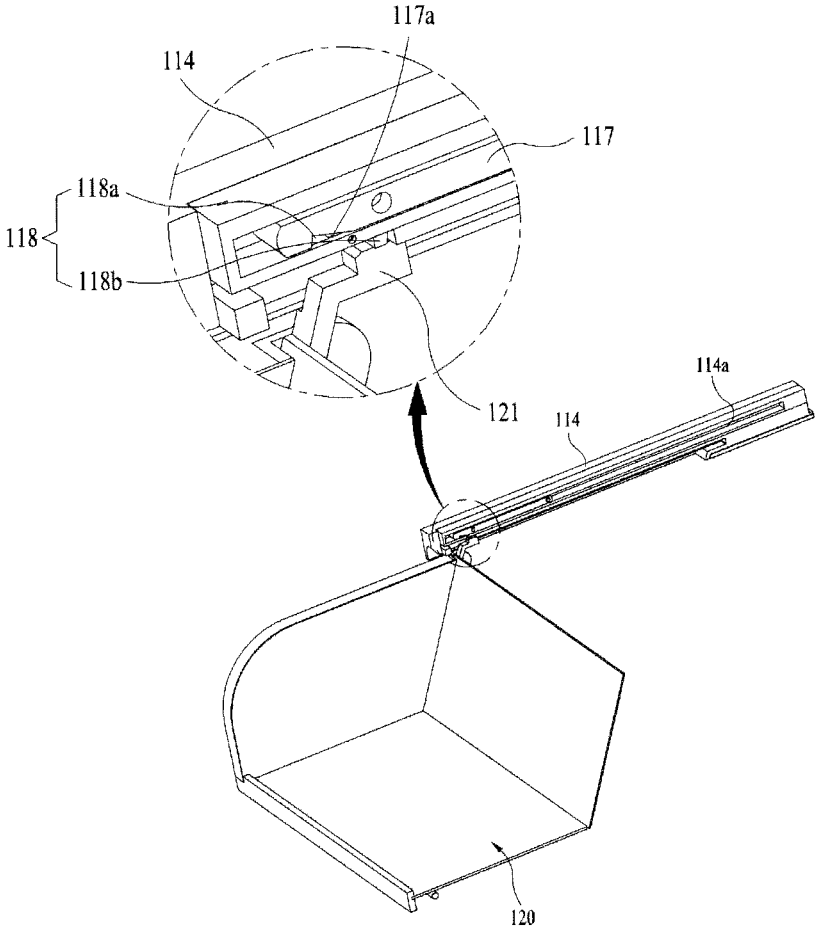
FIG. 4 illustrates partial perspective view of a container, and a second sliding guide.

Referring to FIG. 4, there is a brake for preventing the container 120 from moving backward in a state the container 120 is drawn out of the storage chamber 116*a*.

The brake includes a stopping recess 117*a* in a front portion of the second slider 117 and a stopper 118 connected to the second sliding guide 114 with a hinge. The stopper 118 has a front end shaped to be placed in the stopping recess 117*a*, and connected to the second sliding guide 114 hinged with a torsion spring. It is designed that a rear end 118*b* of the stopper 118 is pushed by a pushing bracket 121 connected to the container 120 at the time the container 120 moves up/down. Accordingly, a brake applied state is released as a front end 118a of the stopper 118 moves away from the stopping recess 117*a* following the rear end 118*b* being pushed by the pushing bracket 121.

In FIG. 4, the stopper 118 is maintained to be in a state the front end 118*a* thereof is always in a sliding groove 114*a* of the second sliding guide 114. In a state the stopper 118 is maintained thus, the stopper 118 is rotated as a front portion of the second slider 117 pushes down the front end 118*a* of the stopper 118 during the container 120 is drawn out until the second slider 117 reaches to the stopping recess 117*a* when the stopper 118 rotates in an opposite direction by restoring force of the torsion spring, placing the front end 118*a* of the stopper 118 in the stopping recess 117*a* of the second slider, thereby braking the second slider 117.

Figure 3:
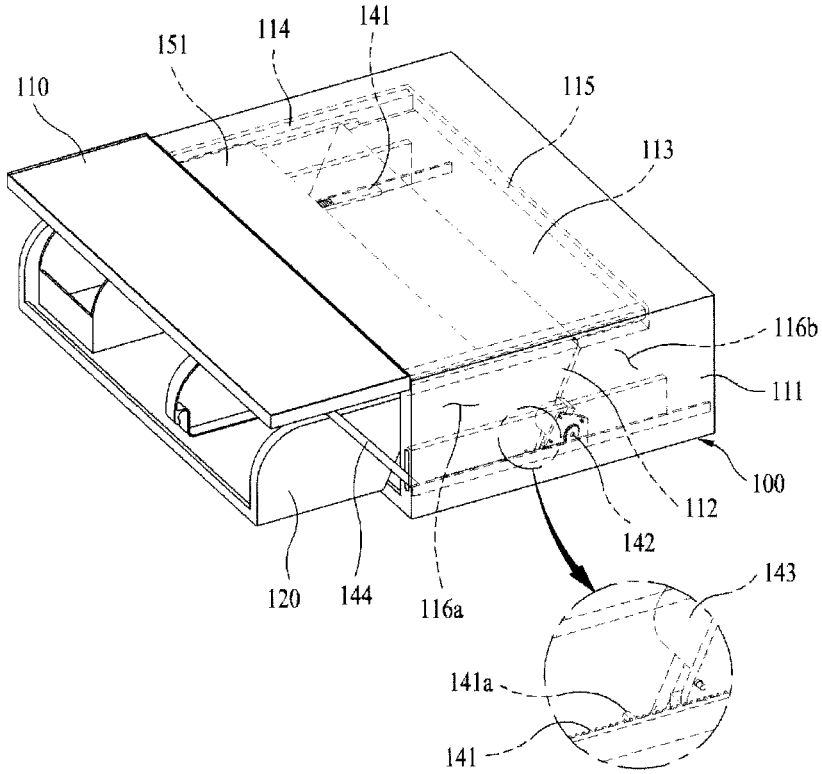
FIG. 3 illustrates a perspective view of the storage chamber.

Further, in FIG. 3, there is a machinery room 116*b* in rear of the storage chamber 116*a* for mounting compressor and the like therein.

In order to provide the machinery room 116*b*, there is a vertical partition 115 connected to a rear side ceiling of the storage chamber 116*a*. And, at a lower end of the vertical partition, there is a horizontal partition 113 connected thereto. Between a front end 118*a* of the horizontal partition 113 and a bottom surface of the storage chamber 116*a*, there is a tilted partition 112 mounted in a tilted position.

Above partitions separate the machinery room 116*b* from the storage chamber 116*a*.

The drawing out plate 151 is placed on the horizontal partition 113 when the container 120 is positioned in the storage chamber 116*a*.

In the foregoing implementation, the storage chamber 116*a* is provided as a space separate from the refrigerating chamber and the freezing chamber, and the door thereof may be also provided separately.

Figure 6:
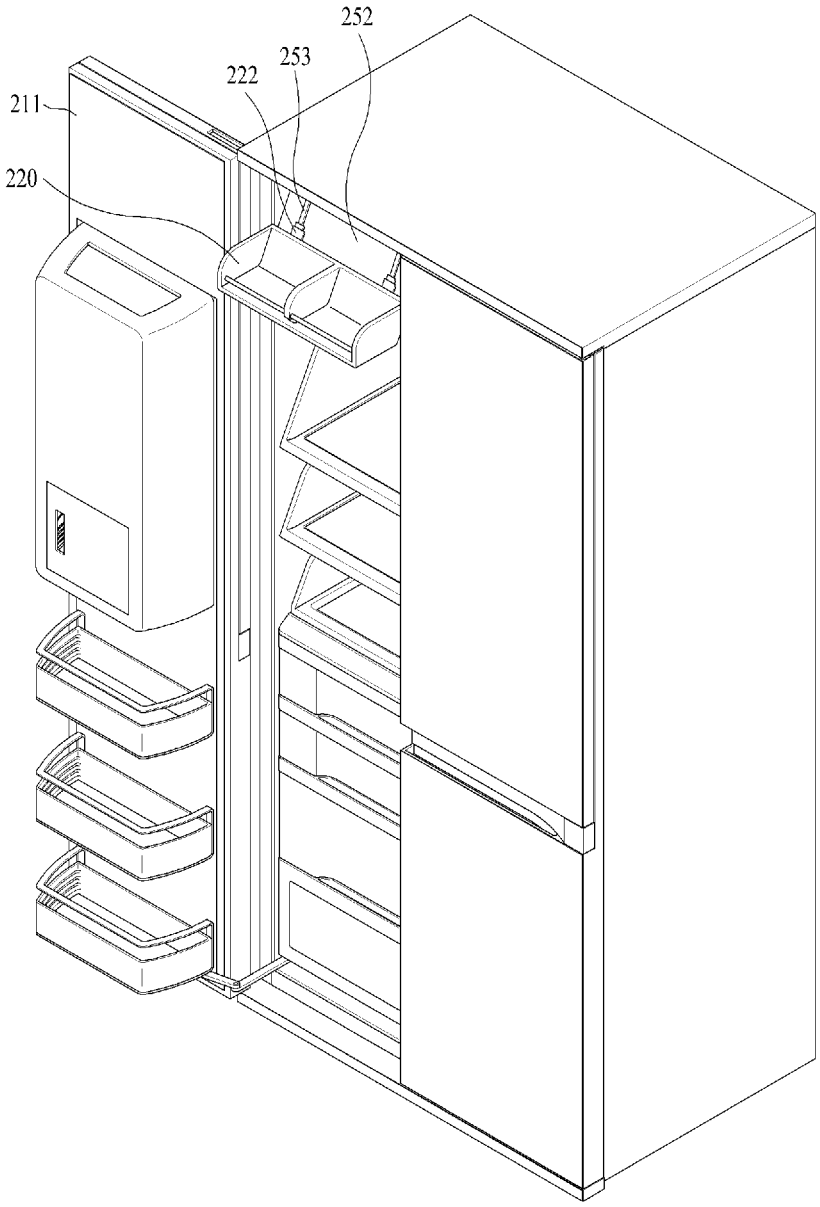
FIG. 6 illustrates a perspective view of a refrigerator in accordance with another preferred embodiment of the present invention.

The container can be mounted together with other shelves or drawers in the low temperature storage chamber which is supplied with the cold air for storing food at a low temperature. Different from the foregoing implementation, no storage space is provided separately, but the foregoing container structure can be mounted in an upper side of the refrigerating chamber or the freezing chamber. Such an implementation is shown in FIG. 6.

In this implementation, no storage chamber 116*a* is provided separately. The container drawing out/pushing in structure and the container moving up/down structure are provided in an upper space of the refrigerating chamber or the freezing chamber. That is, the container structure 220 is mounted in the upper side of the refrigerating chamber or the freezing chamber.

In detail, in the implementation, the container 220 drawing out/pushing structure and the container moving up/down structure are provided to an upper side of the freezing chamber. That is, the drawing out plate (not shown) is mounted to the upper side space of the freezing chamber so as to be drawing out/pushing in alike the foregoing implementation. And, the moving up/down support 252 is mounted coupled to the drawing out plate. The container 220 is mounted so as to be movable along a front surface of the moving up/down support.

The drawing out/pushing structure of the drawing out plate and the moving up/down structure of the container 220 are identical to the foregoing implementation. For an example, the sliding guide 253 is mounted to the moving up/down support and the slider 222 which is slidable along the sliding guide 253 is mounted to the container.

However, different from the foregoing implementation is that, since no storage chamber door is provided in this implementation separately, there are neither link 144, nor rack 141 and motor 143 and so on for automatic opening of the door.

After opening the freezing chamber door 211 and releasing hold of the container after drawing out the container 220 forward, the container 220 moves down by gravity.

In the implementations, by enlarging a storage space of the refrigerator, more food can be stored at a low temperature.

Since the container has a structure of being drawn out and moved down, even if the storage space is enlarge by making the refrigerator taller, convenience of use can be maintained.

It will be apparent to those skilled in the art that various modifications and variations can be made in the present disclosure without departing from the spirit or scope of the inventions. Thus, it is intended that the present disclosure covers the modifications and variations of this disclosure provided they come within the scope of the appended claims and their equivalents.

What is claimed is:

1. A refrigerator comprising:

a cold air generator configured to generate cold air;

a first storage chamber configured to receive the cold air generated by the cold air generator;

a first storage chamber door configured to open and close an access point to the first storage chamber and configured to store at least one of food and ice stuffs;

a second storage chamber, having a container and positioned on the first storage chamber, wherein the container is configured to be movable in front and rear directions as well as up and down directions;

a second storage chamber door configured to open and close the second storage chamber, wherein an upper side of the second storage chamber door is rotatably fixed to enable a lower side of the second storage chamber door to open rotatably;

a plurality of links rotatably connected to the second storage chamber door and configured to rotate to expose the container of the second storage chamber;

a plurality of racks respectively connected to the links; and a support connected to a rear surface of the container and configured to support the container when the container moves up and down from a top of the first storage chamber, wherein the links are provided on both sides of the second storage chamber door and the racks are provided on both sides of the second storage chamber, and wherein the support has a sloped front surface defined as a plane and the container moves simultaneously down and forward along the sloped front surface when moving down from the top of the first storage chamber, and moves simultaneously up and backward along the sloped front surface when moving up to the top of the first storage chamber.

2. The refrigerator of claim 1, wherein the container is configured to be movable up and down.

3. The refrigerator of claim 2, wherein the container is configured to move down with no electrical driving force.

4. The refrigerator of claim 1, wherein the container is configured to slidably move in front and rear directions.

5. The refrigerator of claim 1, further comprising: a speed reducing device mounted to the support and configured to reduce a moving down speed of the container.

6. The refrigerator of claim 1 further comprising: a first slider mounted to the support, and configured to slide along a first sliding guide.

7. The refrigerator of claim 1, further comprising:

a drawing out plate slidably connected to the second storage chamber.

8. The refrigerator of claim 7, further comprising:

a second slider mounted to the drawing out plate and configured to be slidably along a second sliding guide.

9. The refrigerator of claim 8, further comprising:

a stopper connected to the second sliding guide and configured to prevent the container from moving beyond the stopper in a reversal direction.

10. The refrigerator of claim 1, wherein the first storage chamber is at least one of a refrigerating chamber and a freezing chamber.

11. The refrigerator as claimed in claim 1, further comprising:

a compressor positioned in a rear part of the second storage chamber and configured to compress a refrigerant.

12. The refrigerator of claim 1, further comprising:

a motor configured to move the container in response to a command.

13. The refrigerator of claim 1, wherein the links and the racks are configured to allow the container to move to a position where at least a portion of the container is lower than a lowermost wall of the second storage chamber.

14. A refrigerator comprising:

a cold air generator configured to generate cold air;

a first storage chamber configured to receive the cold air generated by the cold air generator;

a storage chamber door configured to open and close at least the first storage chamber and configured to store at least one of food and ice stuffs;

a second storage chamber, having a container and positioned on the first storage chamber, wherein the container is configured to be movable in front and rear directions;

a second storage chamber door configured to open and close the second storage chamber, wherein an upper side of the second storage chamber door is rotatably fixed to enable a lower side of the second storage chamber door to open rotatably;

a plurality of links rotatably connected to the second storage chamber door and configured to rotate to expose the container of the second storage chamber;

a plurality of racks respectively connected to the links and configured to move the container forward and backward;

a support connected to a rear surface of the container and configured to allow the container to move down and forward or up and backward; and wherein the links are provided on both sides of the second storage chamber door and the racks are provided on both sides of the second storage chamber; and wherein, as the lower side of the second storage chamber door rotates upward to open the second storage chamber, the links and the racks slide the container forward until the container exits the second storage chamber and then the links and the racks allow the container to move downward; and wherein the support has a sloped front surface defined as a plane, the racks guide movement of the container as the container slides forward, the support does not guide movement of the container as the container slides forward, the support guides movement of the container as the container moves simultaneously down and forward along the sloped front surface, the racks do not guide movement of the container as the container moves down and forward, and the support guides movement of the container as the container moves simultaneously up and backward along the sloped front surface.

15. The refrigerator of claim 14, wherein the container is configured to be movable up and down.

16. The refrigerator of claim 14, further comprising:

a drawing out plate slidably connected to the second storage chamber,

17. The refrigerator of claim 16, further comprising:

a slider mounted to the drawing out plate and configured to be slidable along a sliding guide.

18. The refrigerator of claim 14, further comprising:

a stopper connected to a sliding guide and configured to prevent the container from moving in a reversal movement.

19. The refrigerator of claim 14, wherein the first storage chamber is at least one of a refrigerating chamber and a freezing chamber.

20. The refrigerator as claimed in claim 14, further comprising:

a compressor positioned in a rear part of the second storage chamber and configured to compress a refrigerant.

21. The refrigerator of claim 14, wherein the container is configured to move in front and rear directions.

22. The refrigerator of claim 14, wherein the links and the racks are configured to allow the container to move to a position where at least a portion of the container is lower than a lowermost wall of the second storage chamber.

23. A refrigerator comprising:

a cold air generator configured to generate cold air;

a first storage chamber configured to receive the cold air generated by the cold air generator;

a first storage chamber door configured to open and close an access point to the first storage chamber and configured to store at least one of food and ice stuffs;

a second storage chamber having a container to slidably be movable in front and rear directions, a second storage chamber door configured to open and close the second storage chamber, wherein the second storage chamber door rotates on a horizontal axis to open the second storage chamber, and an upper side of the second storage chamber door is rotatably fixed to enable a lower side of the second storage chamber door to open rotatably;

a connecting member configured to connect the second storage chamber door with the container; and a support connected to a rear surface of the container, the support having a sloped front surface defined as plane, wherein, when the second storage chamber door stops rotating to close the second storage chamber, the container stops moving in horizontal direction, wherein, as the lower side of the second storage chamber door rotates upward to open the second storage chamber, the container moves forward until the container exits the second storage chamber and then the container moves simultaneously downward and forward along the sloped front surface, and wherein the container moves simultaneously up and backward aloe the sloped front surface when returning to the second storage chamber.

24. The refrigerator of claim 23, wherein, when the second storage chamber door starts rotating to open the second storage chamber, the container starts moving in horizontal direction.

25. The refrigerator of claim 23, further comprising:

a stopping member configured to stop horizontal movement of the container when the container is located on a predetermined position, wherein the container is accommodated to the second storage chamber in the predetermined position.

26. The refrigerator of claim 25, wherein the stopping member comprises:

a drawing out plate configured to guide a horizontal movement of the container and a sliding groove configured to guide a movement of the drawing out plate.

27. The refrigerator of claim 23, wherein the connecting member comprises:

a plurality of links rotatably connected to the second storage chamber door and configured to rotate to expose the container of the second storage chamber; and a plurality of racks respectively connected to the links;

wherein the links are provided on both sides of the second storage chamber door and the racks are provided on both sides of the second storage chamber.

* * * * *